United States Patent [19]

Miller

[11] Patent Number: 4,821,883

[45] Date of Patent: Apr. 18, 1989

[54] JEWELRY HOLDER

[76] Inventor: Kathern M. Miller, 4222 Meadow La., Lorain, Ohio 44055

[21] Appl. No.: 141,543

[22] Filed: Jan. 7, 1988

[51] Int. Cl.[4] ..... B65D 73/00

[52] U.S. Cl. ..... 206/495; 206/486; 206/566; 206/225; 383/17

[58] Field of Search ..... 206/486, 495, 566, 376, 206/373, 225, 45.14; 150/52 C; 383/17, 38, 39

[56] References Cited

U.S. PATENT DOCUMENTS

| | | | |
|---|---|---|---|
| D. 224,370 | 7/1972 | Berry | 383/17 |
| 770,354 | 9/1904 | Corfman | 383/39 |
| 962,595 | 6/1910 | Smith | 383/39 |
| 1,094,009 | 4/1914 | Parkhurst | 206/373 |
| 1,513,514 | 10/1924 | London | 383/39 |
| 1,526,122 | 2/1925 | Dau | 383/39 |
| 1,579,023 | 3/1926 | Myers | 383/39 |
| 1,872,649 | 8/1932 | Berg | 206/566 |
| 2,218,892 | 10/1940 | Ratzlaff | 150/52 C |
| 2,821,298 | 1/1958 | Richards | 206/225 |
| 2,861,682 | 11/1958 | Hatcher | 206/566 |
| 4,177,846 | 12/1979 | Rountree | 150/52 C |
| 4,181,224 | 1/1980 | Aber | 206/486 |
| 4,223,783 | 9/1980 | Marshall | 206/225 |
| 4,401,219 | 8/1983 | Mink | 206/495 |
| 4,420,084 | 12/1983 | Whelan | 206/566 |
| 4,606,458 | 8/1986 | LaBate | 206/566 |
| 4,687,103 | 8/1987 | Corbet | 206/495 |
| 4,718,544 | 1/1988 | Barbato | 206/495 |

FOREIGN PATENT DOCUMENTS

| | | | |
|---|---|---|---|
| 1270424 | of 1961 | France | 206/566 |
| 23957 | of 1904 | United Kingdom | 206/566 |

*Primary Examiner*—David T. Fidei
*Attorney, Agent, or Firm*—Gustalo Nunez

[57] ABSTRACT

A foldable apparatus for holding post-type earrings, medals and any other jewelry equipped with a post-type connecting means. The apparatus having a sheet of aida cloth and a sheet of craft foam bonded together and in which said aida cloth approximates a mesh screen containing a plurality of apertures. Said post earrings and the like are inserted through the combination of the aida cloth and craft foam and are held in place.

1 Claim, 3 Drawing Sheets

JEWELRY HOLDER

FIELD OF THE INVENTION

This invention is directed to a jewelry holder, specifically to a holding apparatus for post-type earrings and the like.

BACKGROUND OF THE INVENTION

Throughout the years of recorded history men and women have been eager to possess and use ornamental jewelry about their clothing and person. Earrings in particular have been used by both sexes, and still are for reasons which are both varied and ornamental. Even at this date men and women wear earrings to convey messages to those about them; indeed, some wear a plurality of earrings. One type which is in great use is the post-type earrings which are used by those persons having pierced ears. A post-type earring is that type which has a body portion, a decorative portion which is placed on the ear such that it is readily visible, and an elongated needle-type portion.

As a result of the attractiveness of the use of earrings, many people, particularly women, have acquired fairly large collections of earrings for the pleasure of variety. This results in the problem of having adequate means to store the earrings and adequate means for displaying the earrings. For example, when going on a trip if one simply placed the earrings in a bag or purse type receptacle, the earrings could become scratched or could get caught up with other earrings. Also, one must sort through the receptacle to find the earrings desired.

Various types of devices and apparatus have been known and in use for displaying earrings and other items. For example, U.S. Pat. No. 4,181,224 to Aber discloses an apparatus for displaying and/or storing post-type earrings. The Aber apparatus consists of two layers of sheet plastic materials having a filler material between the two sheets and filler material adjacent one of the plastic sheets. The layers of sheet plastic material have a plurality of holes therethrough such that the holes on one sheet are in direct axial alignment with the holes on the second sheet.

Another example of an apparatus for holding earrings of the post configuration type is disclosed in U.S. Pat. No. 4,606,458 to LaBate. LaBate discloses a mesh type of material placed upon a frame whereby the earrings are inserted through the mesh material and which are held in place by the relative friction between the post and mesh covering.

SUMMARY OF THE INVENTION

A jewelry holding apparatus comprising a sheet of material such as aida cloth and a sheet of material such as craft foam partially reinforced with wire. The jewelry, such as post-type earrings and the like, are inserted through the double-ply holding apparatus and are retained thereon by the combined action of the friction applied by the double-ply material and a clasp which is placed over the post of the earring.

DESCRIPTION OF THE PREFERRED EMBODIMENT

Figure 1:
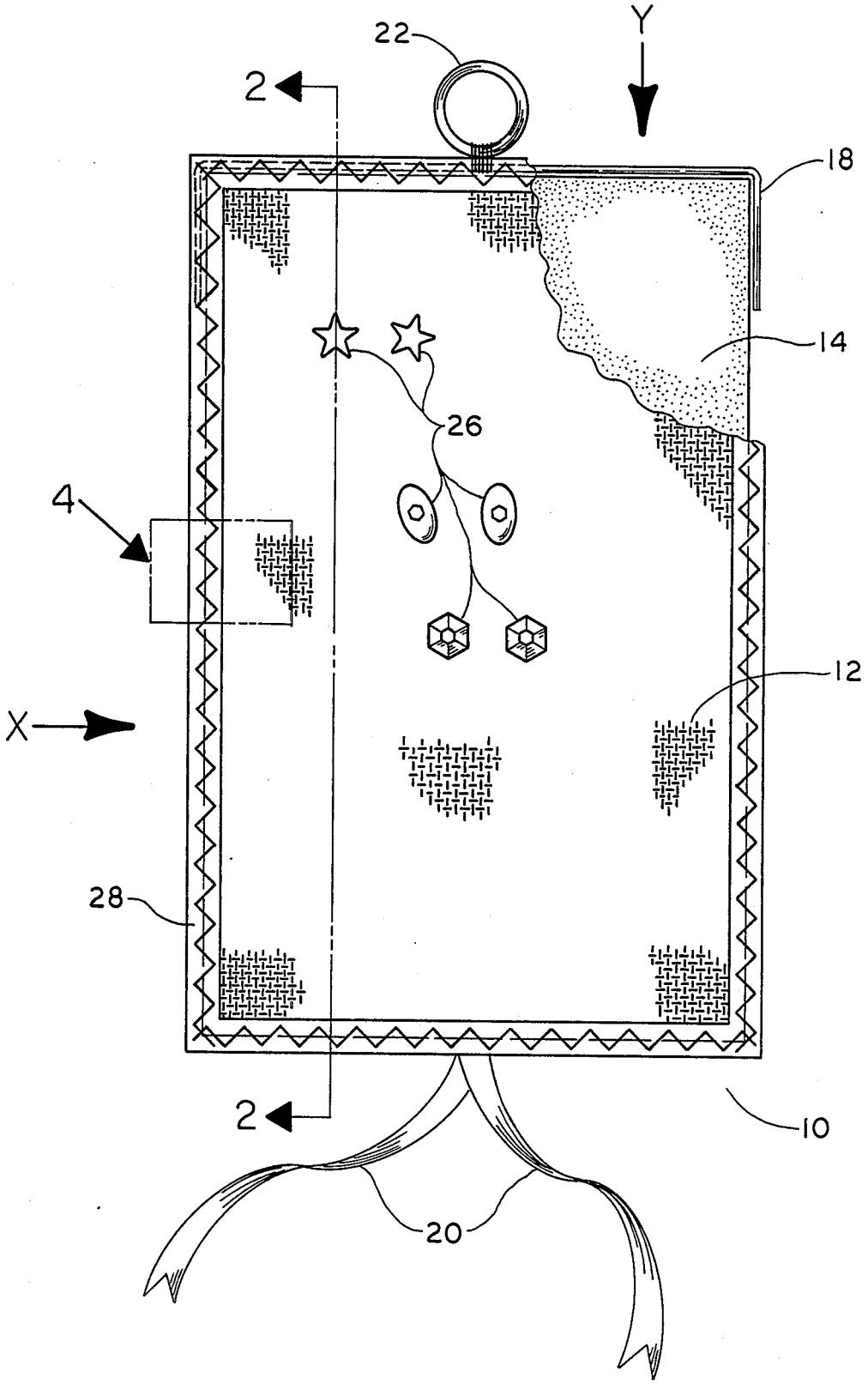
FIG. 1 is a front plan view of the jewelry holding apparatus.
Figure 2:
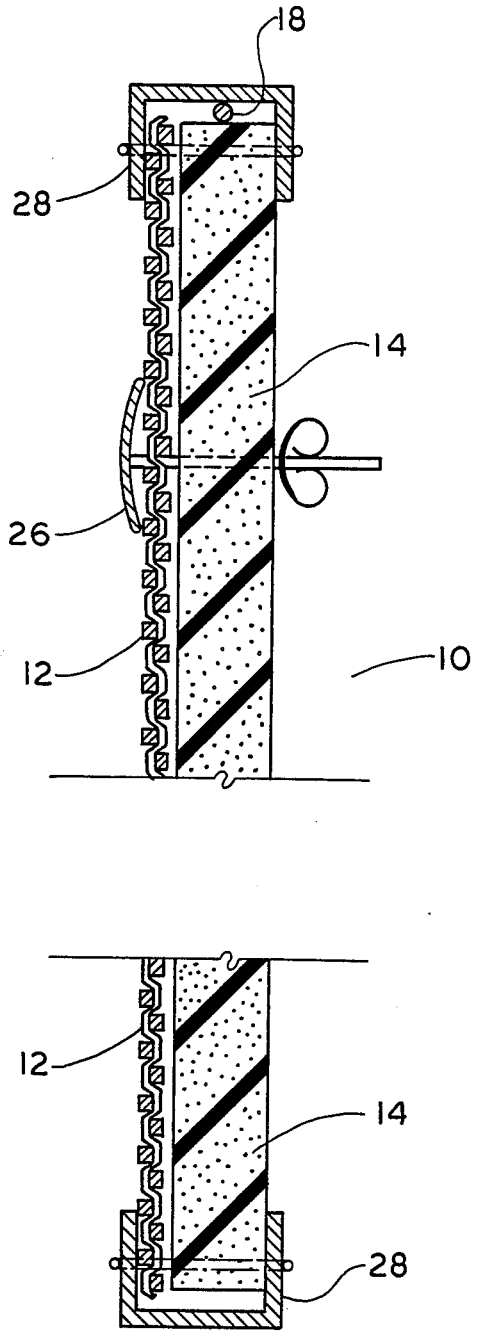
FIG. 2 is a side view of the jewelry holding apparatus taken along lines 2—2.
Figure 3:
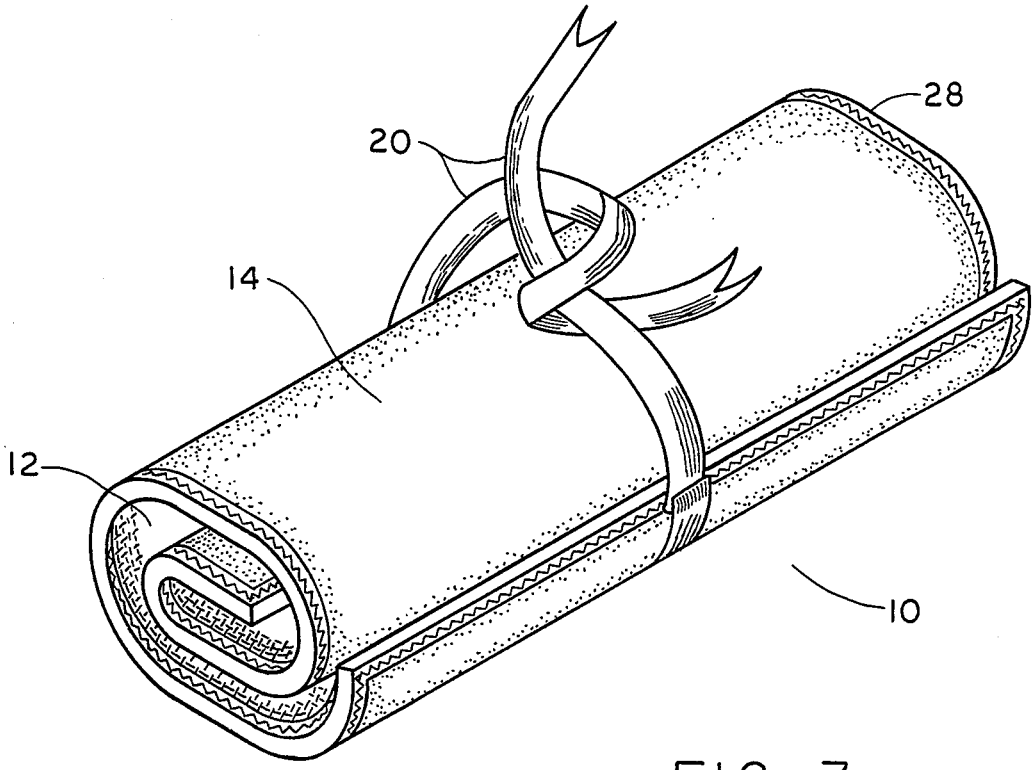
FIG. 3 is a perspective view of the jewelry holding apparatus shown in a rolled-up position.
Figure 4:
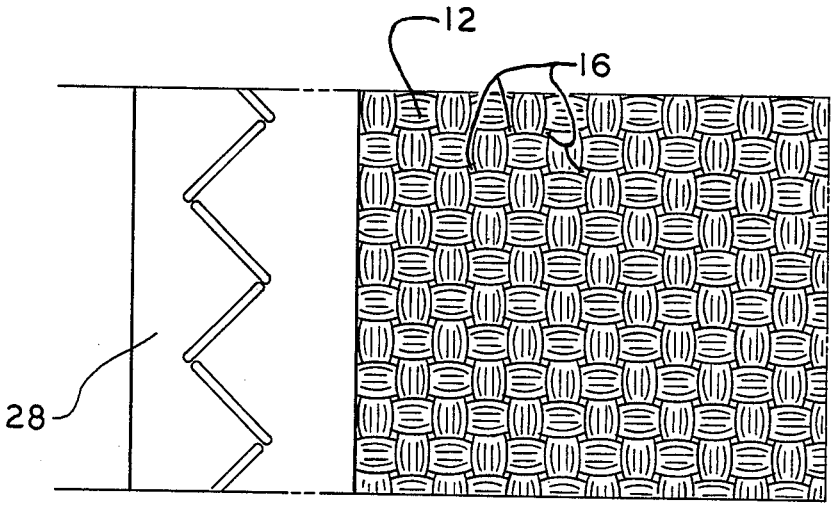
FIG. 4 is an exploded view of the sheet material at 4 of FIG. 1 illustrating the stitching used on the entire perimeter of the jewelry holding apparatus.

A jewelry holding device for holding, displaying and transporting jewelry such as post-type earrings is shown at 10. The holding device 10 consists of a sheet of aida cloth 12 which is bonded to a sheet of craft foam 14. The aida cloth 12 resembles a mesh-type material which contains a plurality of apertures throughout its entire surface. At one end thereof, there is a wire 18, shown by hatch marks in FIG. 1, sewn by conventional methods known to those skilled in the art. The preferred size of the wire is 18 gauge. The wire 18 provides a certain amount of strength to the holding device in that it prevents the holding device from being folded in an "X" direction but allows the holding device to be folded in a "Y" direction. In the preferred embodiment there is shown a pair of cords 20 which are used to retain the holding devices in a rolled-up condition. If one desires, an ornamental fringe can be provided around the perimeter of the holding device 10. The holding device 10 is also provided with a closed loop 22 at one end.

To use the holding device 10, one merely inserts the post of the earring through the combined sheets of aida cloth and craft foam and locks it in place simply by attaching the post clasp. The user, in the event he wants the jewelry displayed for easy access and choice, can simply hang it up by use of the loop 22. Also, because of the feature of rolling up the holding device 10, it is very convenient for the user to carry the jewelry in a purse or like container.

The invention may be embodied in other specific forms without departing from the spirit thereof. The preferred embodiment is therefore to be considered in all respects as illustrative and not restrictive, the scope of the invention being indicated by the appended claims, rather than by the foregoing specification.

What I claim is:

1. A device, having an X and Y longitudinal axes, for the display and storing of jewelry articles having a post-type configuration at one end thereof;

a first sheet of mesh cloth, said mesh cloth provided with a plurality of apertures, a second sheet of craft foam bonded to said first sheet of mesh cloth;

said device provided with loop means at one end thereof and strings means at another end thereof and being further provided with wire means at the same end in which said loop means is provided, said wire means preventing said device from folding along the X axis but permitting said device to be folded along the Y axis, and said bonded sheets of mesh cloth and craft foam adapted to receive and engage the post of said jewelry such that the ornamental portion of said jewelry is visible to the user.

* * * * *